US006041982A

United States Patent [19]

Cautereels et al.

[11] Patent Number: 6,041,982

[45] Date of Patent: Mar. 28, 2000

[54] BEVERAGE CONTAINER WITH CAP AND SPOUT

[75] Inventors: Victor J. J. Cautereels, Ranst; Dimitri M. C. J. Backaert, Aalst, both of Belgium

[73] Assignee: Dart Industries Inc., Orlando, Fla.

[21] Appl. No.: 09/248,240

[22] Filed: Feb. 10, 1999

[51] Int. Cl.[7] ..... B65D 47/00

[52] U.S. Cl. ..... 222/562; 222/568; 222/573; 215/307; 220/366.1

[58] Field of Search ..... 222/562, 566, 222/567, 568, 573; 215/207; 220/366.1

[56] References Cited

U.S. PATENT DOCUMENTS

| | | | |
|---|---|---|---|
| D. 395,783 | 7/1998 | Cautereels | D7/318 |
| 4,763,804 | 8/1988 | O'Connell | 215/307 |
| 5,533,633 | 7/1996 | King | 215/307 |
| 5,551,608 | 9/1996 | Moore et al. | 222/562 |
| 5,785,196 | 7/1998 | Montgomery | 220/366.1 |
| 5,871,128 | 2/1999 | Carroll | 222/568 |
| 5,899,349 | 5/1999 | Moore | 215/307 |

FOREIGN PATENT DOCUMENTS

| | | | |
|---|---|---|---|
| 3906322 | 9/1989 | Germany | 222/568 |

*Primary Examiner*—Joseph A. Kaufman
*Attorney, Agent, or Firm*—Taylor J. Ross

[57] ABSTRACT

A beverage container having a base and a cap threaded thereto, and which may be used with a spout mounted to the container mouth. The cap includes a shoulder section having a rim contact section to seal to the container upper rim when the spout is not employed. The shoulder section also includes a spout contact section having a cam surface. The spout includes a follower ridge which is engaged by the cam surface to retain the spout in position as the cap is rotated for removal. This permits the spout to vent any accumulated pressure from a stored carbonated beverage, and thus prevents the spout from being disengaged from the base due to the accumulated pressure.

7 Claims, 3 Drawing Sheets

BEVERAGE CONTAINER WITH CAP AND SPOUT

CROSS-REFERENCE TO RELATED APPLICATIONS

This application is related to Ser. No. 29/100,384 filed Feb. 10, 1999, now U.S. Pat. No D417,821 and Ser. No. 29/100,383 filed Feb. 10, 1999, now U.S. Pat. No. D416, 171, which are incorporated by reference herein and made a part hereof, including but not limited to those portions which specifically appear hereinafter.

STATEMENT REGARDING FEDERALLY SPONSORED RESEARCH

Not Applicable.

BACKGROUND OF THE INVENTION

The present invention relates in general to beverage containers for personal use. In particular, the present invention relates to a beverage container which may be used for storing and dispensing a single serving of carbonated and non-carbonated beverages.

In the home, beverages are often transferred from original packaging to a container for personal use. Such containers are currently available in a variety of forms. In the general sense, these containers consist of a base defining a cavity for retaining the beverage and a cap for sealing the base. For storing non-carbonated beverages, the seal between the base and cap is often of primary concern, as leakage poses the obvious problems of beverage loss, beverage contamination, and mess. The seal is also important for the storage of carbonated beverages for the same reasons. Further, the seal must additionally be to some degree gas-tight to retain the carbonation for the desired period of time.

While the seal is thus also important for carbonated beverage containers, a greater concern is typically the danger posed by the build-up of pressure within the container, especially during removal of the cap. Specifically, the internal pressure acts upon the underside of the cap tending to force it away from the base. As the user removes the cap, this pressure may cause the cap to be expelled from the container in a very energetic manner. This may even be so energetic as to cause danger to the user.

SUMMARY OF THE INVENTION

An object of the present invention is to provide a container which will store a beverage with freshness for a predetermined desired amount of time.

Another object of the present invention is to provide such a container which has a sufficient seal for use with both carbonated and non-carbonated beverages.

A further object of the present invention is to provide such a container which automatically vents internal pressure during opening.

Yet another object of the present invention is to provide such a container which has a simple design using only a few parts which may each be easily mass-produced.

These and other objects are achieved by a beverage container having a base and a cap threaded thereto, and which may be used with a spout mounted to the container mouth. The cap includes a shoulder section having a rim contact section to seal to the container upper rim when the spout is not employed. The shoulder section also includes a spout contact section having a cam surface. The spout includes a follower ridge which is engaged by the cam surface to retain the spout in position as the cap is rotated for removal. This permits the spout to vent any accumulated pressure from a stored carbonated beverage, and thus prevents the spout from being disengaged from the base due to the accumulated pressure.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
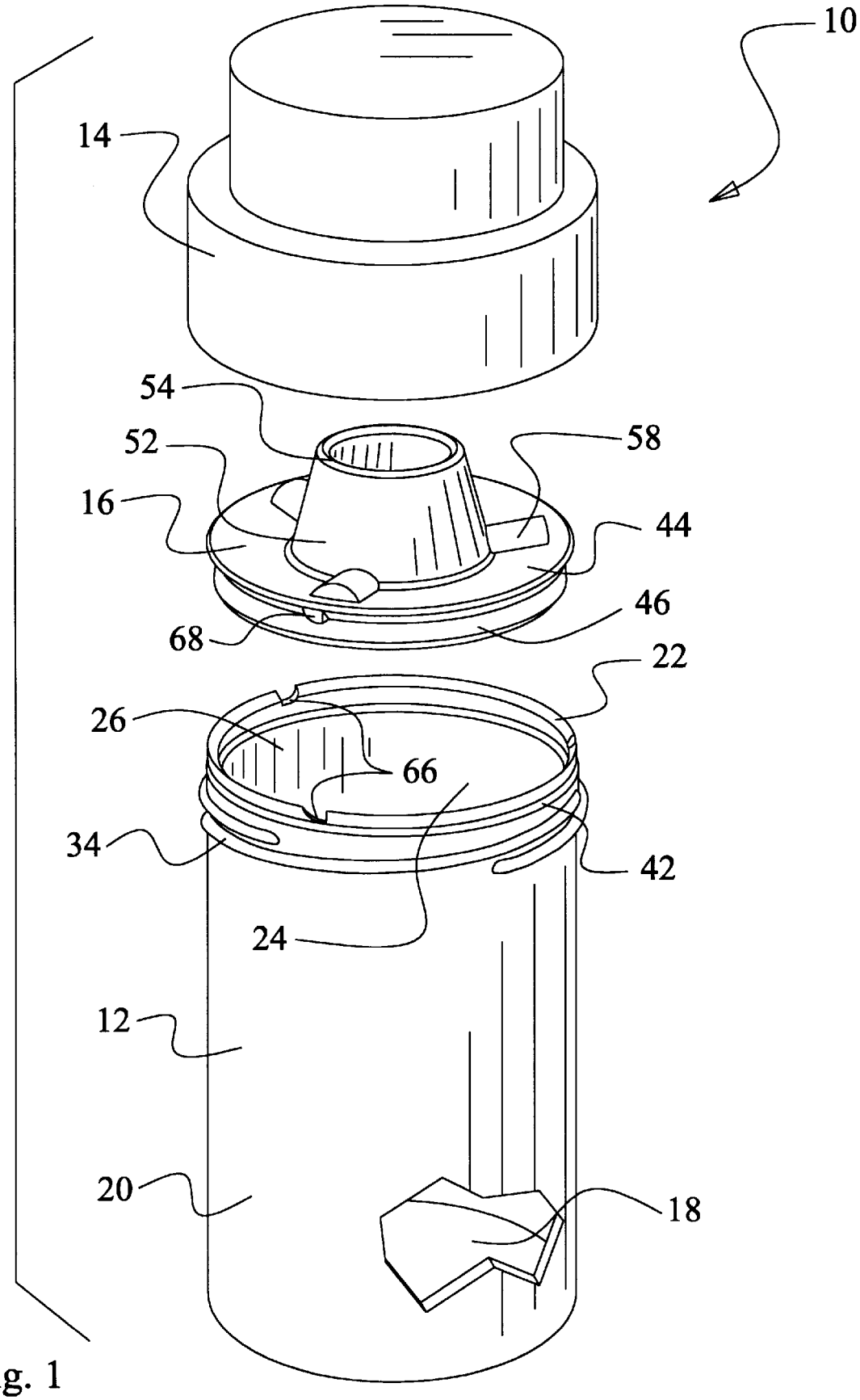
FIG. 1 is an exploded perspective view of a container according to the present invention showing the base, spout and cap.

With reference to FIG. 1, a container according to the present invention is generally designated by reference numeral 10. The container 10 includes at least a base 12 and a cap 14, and may further include a spout 16. In particular, when used to store non-carbonated beverages, the base 12 and cap 14 may be used alone (but may also be used with the spout 16). However, when used to store carbonated beverages, the base 12 and cap 14 will be used with the spout 16.

The base 12 includes a bottom wall 18 having a periphery, and a side wall 20 extending upward from this periphery, and ending at an upper rim 22. While the periphery of the bottom wall 18 may have various shapes, the upper rim 22 will be circular. The bottom wall 18 and side wall 20 together define a container interior 24 which may receive the beverage to be stored. The upper rim 22 further defines a mouth 26 providing access to, and egress from, this interior. The bottom wall 18 and side wall 20 may be formed of various materials such as glass, metal or plastic, and may be of the same or diverse materials. It is preferred, however, that they be formed as a monolithic plastic unit formed by injection molding. This is due not only to reduced cost, but also to permit sufficient deformation of the upper rim 22 (described more fully below) which may be difficult to achieve using more rigid materials such as glass or metal.

Figure 2:
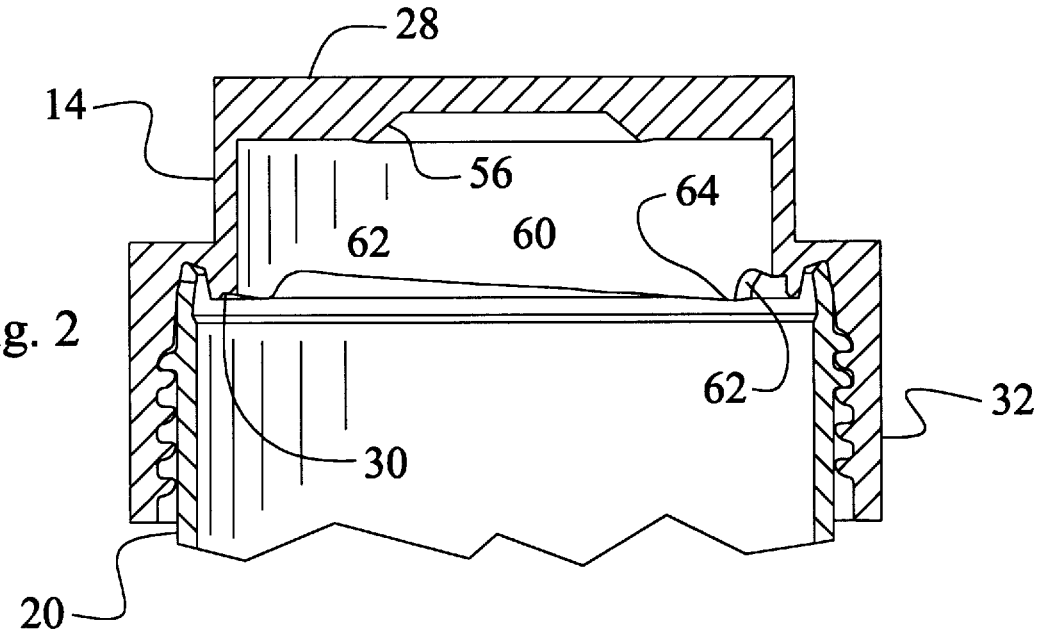
FIG. 2 is a detail cross-sectional view of the assembled base and cap of the container of FIG. 1.
Figure 5:
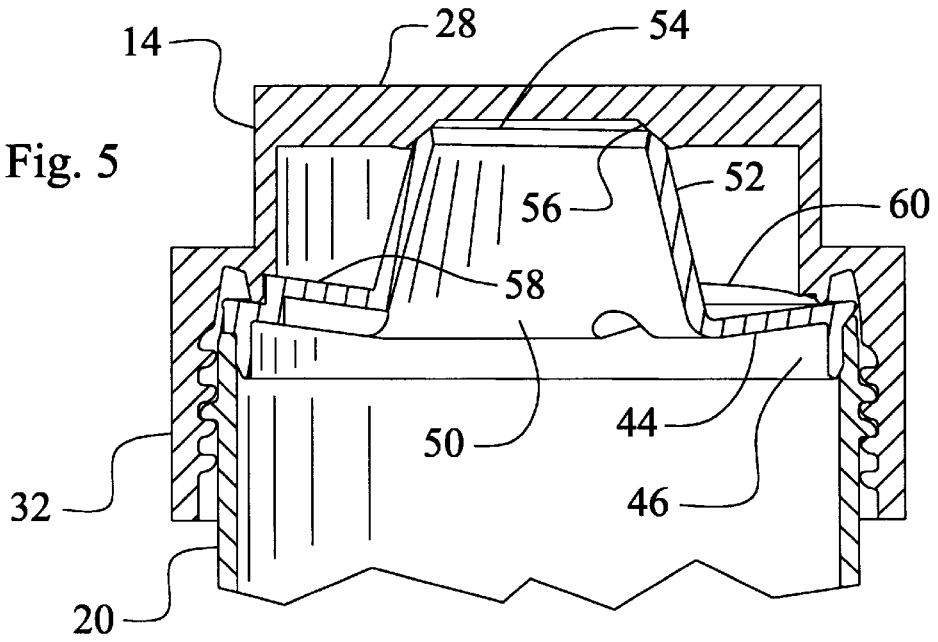
FIG. 5 is a detail cross-sectional view of the assembled base, spout and cap of the container of FIG. 1.
Figure 6:
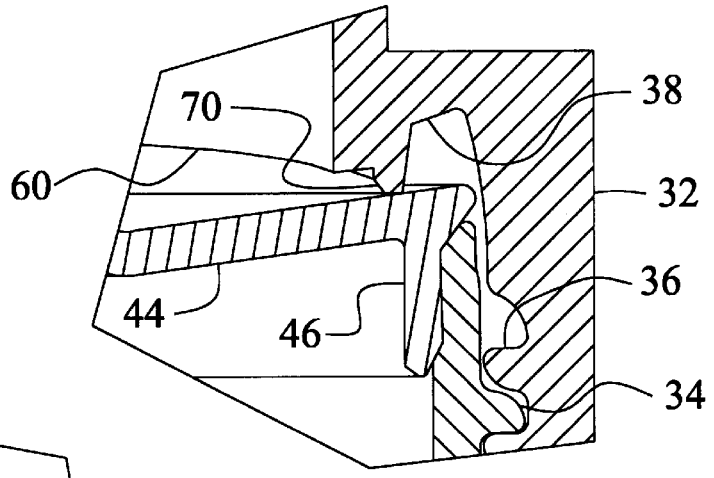
FIG. 6 is a cross-sectional view showing a detail of FIG. 5.
Figure 7:
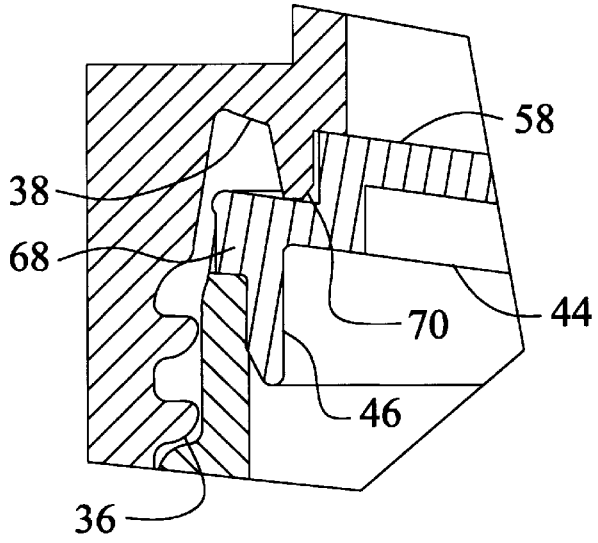
FIG. 7 is a cross-sectional view showing a second detail of FIG. 5.

As noted, a beverage may be stored within the interior 24 of base 12. To prevent unintended egress of the beverage, the cap 14 is provided and serves to close the interior 24. As best illustrated in FIG. 2, the cap 14 includes a central portion 28 having generally domed shape with a lower edge, a shoulder section 30 at this lower edge, and a skirt 32 extending downward from the shoulder section 30. The skirt 32 generally has an inner diameter slightly greater than the outer diameter of the base 12, and threads 34 are formed on the base 12 to mate with inner threads 36 on the interior of skirt 32. The threads 34 and inner threads 36 permit the cap 14 to be secured to the base 12 by threaded engagement. When fully seated, the shoulder section 30 will abut against the upper rim 22, either directly as show in FIGS. 2–4, or via the spout as shown in FIGS. 5–7.

Figure 3:
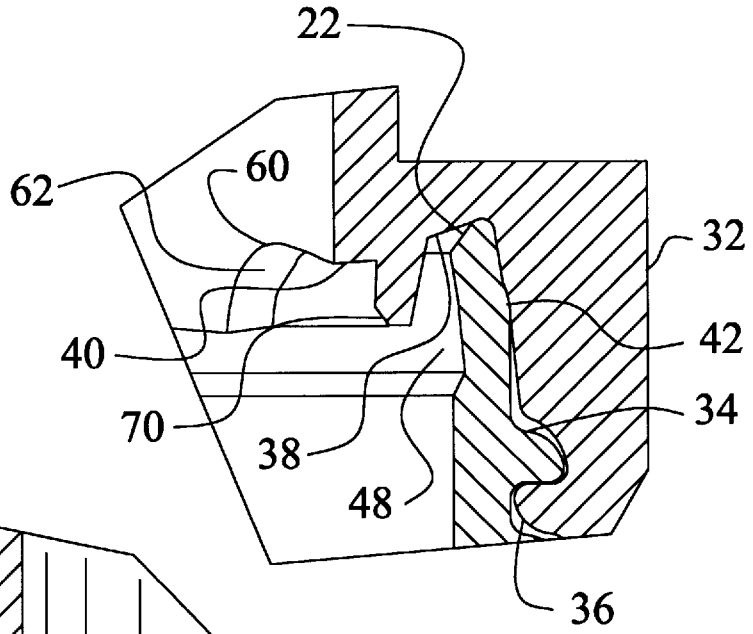
FIG. 3 is a cross-sectional view showing a detail of FIG. 2.
Figure 4:
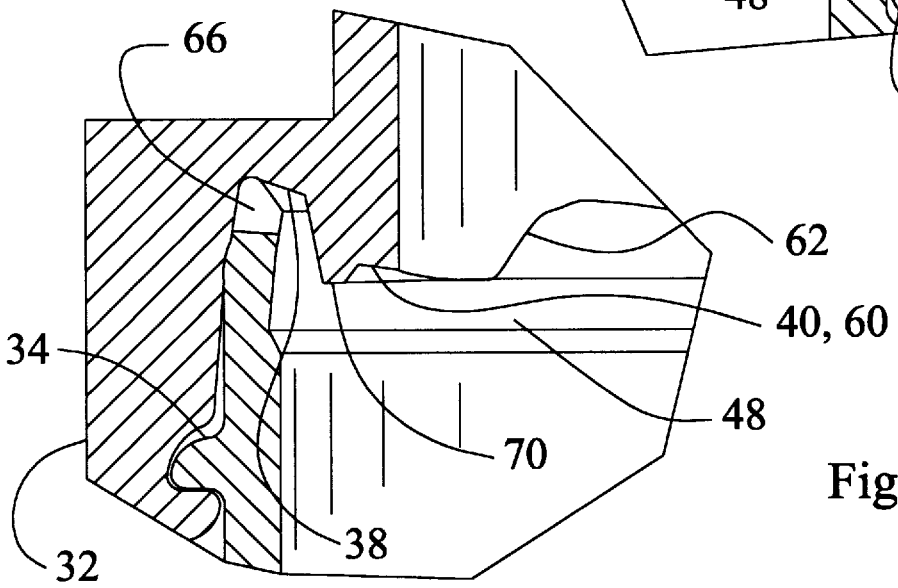
FIG. 4 is a cross-sectional view showing a second detail of FIG. 2.

As best illustrated in FIGS. 3 and 4, the shoulder section 30 is comprised of two distinct sections. These are a rim contact section 38 and spout contact section 40 (described more fully below). The rim contact section 38 is intended to abut directly against the upper rim 22 when the cap 14 is fully seated upon base 12. As may be envisioned, this will serve to block the flow of the beverage from the interior 24. In practice, however, it can be difficult to achieve proper contact, and thus a proper seal, about the entirety of upper rim 22.

To ensure a proper seal, it is preferred that the base 12 include a sealing bead 42 (FIG. 1) extending about the exterior of side wall 20 at a position in proximity to, but spaced from, the upper rim 22. Further, it is preferred that the interior of skirt 32 taper inward adjacent the shoulder section 30, and in particular between shoulder section 30 and the position of the sealing bead 42 when the cap 14 is fully seated. As may be seen, the inward taper will serve to compress upon the sealing bead 42 as the cap 14 moves toward the seated position, providing the desired seal should the upper rim 22 not fully abut rim contact section 38.

The above description should make clear the operation of the container 10 when used with only the base 12 and cap 14. As noted, this use is suitable for non-carbonated beverages. For carbonated beverages, it is preferred (but not required) that the spout 16 also be used. This arrangement will now be discussed.

As shown in FIG. 1, the spout 16 generally includes a main panel 44 which extends across the mouth 26 and has an outer periphery which may rest upon the upper rim 22. Spaced inward from this outer periphery and extending downward is a spout skirt 46 sized to engage the upper rim 22, preferably at the inner face of the side wall 20. In the preferred embodiment shown, the inner face of the side wall 20 includes a circumferential recess 48 which mates with the spout skirt 46. The recess 48 reduces the thickness of the side wall 20 permitting it to more easily expand to receive the spout skirt 46 in a close fit to prevent egress of the beverage. This mating relationship may include an outward taper toward the free edge of the spout skirt 46 as shown.

Extending through the main panel 44 is an aperture 50 through which the beverage will be dispensed. In the preferred embodiment shown, a neck extension 52 having the shape of frustum of a conical tube extends from this aperture 50 to a neck rim 54. This neck extension 52 will preferably have a size approximating the opening of standard carbonated beverage bottles for easy and familiar use in drinking from the neck extension 52. When the cap 14 is fully seated upon the base 12, the central portion 28 will seal the aperture 50. When the preferred neck extension 52 is employed, the central portion 28 will abut against the neck rim 54. It is noted that the cap 14 is rotated about its longitudinal axis during this seating to the base 12, and for this reason it is preferred (but not required) that the neck extension 52 be coaxial with the longitudinal axis of the cap 14. To ensure a proper seal, the inner face of the central portion 28 may include an abutment surface 56 shaped to mate with the neck rim 54 when the cap 14 is seated.

The above elements are all that are strictly required to employ the spout 16. However, this arrangement provides only the benefit of the reduced diameter neck extension 52 for drinking, and no benefits relating to use with carbonated beverages. For these additional benefits, additional structure is required.

Specifically, the spout 16 preferably also includes at least one follower ridge 58 rising above the main panel 44 at a position underlying the spout contact section 40 of shoulder section 30. In the preferred embodiment three such follower ridges 58 are employed at equal angular spacings, and each extends radially outward from the neck extension 52. During the final portion of rotation to mount the cap 14, and conversely the initial portion of rotation to remove the cap 14, the (or each) follower ridge 58 will contact a cam surface 60 formed on the spout contact section 40 of shoulder section 30 (the cam surface 60 being best illustrated in FIG. 2). This contact will ensure that the spout 16 does not move from its position mounted upon the base 12.

The reason for this is the internal pressure developed by carbonated beverages. During the time when the cap 14 is removed, this pressure is easily released to atmosphere through the aperture 50. However, during the period when the cap 14 is seated, the interior 24 is sealed by the spout skirt 46 and the abutment of the central portion 28 against the neck rim 54. This sealed condition will permit this pressure to accumulate. As the cap 14 is later removed, it moves upward and away from the base 12, and away from engagement with neck rim 54. This accumulated pressure, however, will tend to force the spout 16 upward against the cap 14. The pressure can often be sufficient that the spout 16 will actually travel upward with the cap 14 until the spout skirt 46 is disengaged from the base 12. If this occurs near the point where the threads 34 and inner threads 36 disengage, the pressure can cause the cap 14 with spout 16 to be propelled energetically upward and away from the base 12. This represents a danger to the user.

To prevent this, the container 10 will vent the interior 24 well prior to disengagement of the threads 34 and inner threads 36. This is achieved through the use of the follower ridge 58 and cam surface 60. Specifically, the cam surface 60 has the general form of a downward directed shoulder having a first end 62 (FIG. 2) which angles downward toward a second end 64. This angle is substantially equal to that of the threads 34 and inner threads 36. The length of the cam surface 60 will of course be no greater than the circumference at the spout contact section 40, and in the preferred embodiment shown encompasses 120° (there being three cam surfaces 60, one for each of the three follower ridges 58).

The operation of theses elements is as follows. When the cap 14 is fully seated, the cam surface 60 is contacting the follower ridge 58, preventing upward movement, and the cap 14 is oriented with the first end 62 of cam surface 60 close to the follower ridge 58. As the user begins rotation of the cap 14 for removal, the cap rotates with respect to the base 12, and also moves away from the base 12. During this initial rotation, the cam surface 60 slides over the follower ridge 58, with th point of contact maintaining a constant distance from the base 12 and thus retaining the follower ridge 58 in position against upward movement with the cap. As such, the cap is moving upward with respect to the base 12 and spout 16, but the spout 16 is not moving upward. This movement of the cap will then cause the abutment surface 56 to move away from the neck rim 54 in the upward direction. This of course breaks the seal between these elements, and the internal pressure is vented through the neck rim 54 into the interior of the cap 14, and via the threaded engagement of the cap 14, to the atmosphere. As such, it is seen that the movement of the cap 14 restrains upward movement of the spout 16, and permits venting of the container.

The above description of operation relies upon the follower ridge 58 being in the proper position (i.e., adjacent the first end 62 of cam surface 60) when the cap 14 is seated. To ensure this, the angular orientation, i.e., clocking, of the spout 16 with respect to the threads 34 is critical. As best illustrated in FIG. 1, this clocking is achieved by forming a unique mating relationship between the base 12 and spout 16. In particular, the upper rim 22 includes a positioning recess 66 for each follower ridge 58 employed, and the spout 16 includes a like number of positioning projections 68 extending radially outward from the spout skirt 46. This requires that the spout 16 be placed in the proper position upon the base 12 for operation of the cam surface 60. It is noted also that the sealing bead 42 is located below the positioning recess 66, so that the positioning recess 66 does not break the seal formed by the sealing bead 42.

While the above description is sufficient, in the seated condition of cap 14 the cam surface 60 will abut against the follower ridge 58. This small contact area may lead to failure of the material at the follower ridge 58 before the desired product life. To reduce this problem, and thus extend product life, the spout contact section 40 may additionally include a contact ridge 70 located radially outward of cam surface 60, and having a lower edge within a plane perpendicular to the longitudinal axis. This lower edge is located at a position to engage with the main panel 44 when the cap 14 is fully seated, as shown in FIG. 6. As may be envisioned, however, as the cap 14 rotates for removal, the contact ridge 70 will move away from the main panel 44 due to the upward movement of the cap. As such, the contact ridge 70 is effective only when the cap 14 is seated.

From the above description it may be seen that the container 10 will provide a beverage container having a relatively small opening in the spout for ease of drinking, but which permits removal of the spout for easy filling of the container. Further, the container may be employed to safely hold a carbonated beverage by virtue of its venting action upon opening. Beyond this, container 10 may be used without the spout 16 in a conventional manner to hold non-carbonated beverages. In both uses the container 10 provides the proper seals to prevent unintended egress of the beverage due to the unique structure of the shoulder section 30.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A beverage container with cap and spout, having a base with a bottom wall, side wall extending upward therefrom to an upper rim, and threads formed on the exterior thereof, a cap having a central portion, a shoulder section and skirt having inner threads thereon for mating with said threads on said base, characterized by a spout selectively mountable to said base in a specific angular orientation with respect to said threads, said spout including a main panel having an aperture, a spout skirt extending downward from said main panel for engagement with said side wall adjacent said upper rim, and a follower ridge extending upward from said main panel, said shoulder section including a cam surface in the form of a downward facing shoulder having a first end and a second end, said cam surface sloping downward from said first end to said second end at an angle substantially equal to that of said threads, such that said cam surface will slide upon said follower ridge during at least a portion of the rotation of said cap as it is applied and removed, and said cam surface will therefore retain said spout in position as said cap moves upward relative to said base.

2. A beverage container with cap and spout as in claim 1, wherein said shoulder section further includes a rim contact section which will seal against said upper rim when said spout is not positioned upon said base.

3. A beverage container with cap and spout as in claim 1, wherein said specific angular orientation is achieved by a positioning recess extending into said upper rim, and a mating positioning projection extending from said spout skirt.

4. A beverage container with cap and spout as in claim 1, wherein said spout further includes a neck extension extending upward from said aperture, and ending at a neck rim, said central portion of said cap sealing against said neck rim when said cap is fully seated upon said base.

5. A beverage container with cap and spout as in claim 4, wherein said shoulder section further includes a rim contact section which will seal against said upper rim when said spout is not positioned upon said base.

6. A beverage container with cap and spout as in claim 5, wherein said spout skirt is received within said upper rim, and said specific angular orientation is achieved by a positioning recess extending into said upper rim, and a mating positioning projection extending from said spout skirt.

7. A beverage container with cap and spout as in claim 6, wherein said neck extension is coaxial with a longitudinal axis of said cap, and an inner surface of said central portion includes an abutment surface against which said neck rim seals when said cap is seated.

* * * * *